US009702534B1

(12) United States Patent
Brion

(10) Patent No.: US 9,702,534 B1
(45) Date of Patent: Jul. 11, 2017

(54) ILLUMINATION SYSTEM FOR SAFETY HELMET

(71) Applicant: Light Shield Products LLC, Lock Haven, PA (US)

(72) Inventor: Stephen Lee Brion, Lock Haven, PA (US)

(73) Assignee: Light Shield Products LLC, Lock Haven, PA (US)

( * ) Notice: Subject to any disclaimer, the term of this patent is extended or adjusted under 35 U.S.C. 154(b) by 846 days.

(21) Appl. No.: 13/681,609

(22) Filed: Nov. 20, 2012

Related U.S. Application Data

(60) Provisional application No. 61/562,608, filed on Nov. 22, 2011.

(51) Int. Cl.
*F21V 21/084* (2006.01)
*A42B 3/04* (2006.01)
*A42B 1/24* (2006.01)

(52) U.S. Cl.
CPC ..... *F21V 21/084* (2013.01); *A42B 1/242* (2013.01); *A42B 1/244* (2013.01); *A42B 3/044* (2013.01); *A42B 3/0446* (2013.01)

(58) Field of Classification Search
CPC ..... A42B 1/24; A42B 1/242; A42B 1/244; A42B 1/248; A42B 3/044; A42B 3/0446; F21L 15/06–15/10
USPC ..... 362/105, 106, 190, 191; 2/5, 6.2
See application file for complete search history.

(56) References Cited

U.S. PATENT DOCUMENTS

| | | | | |
|---|---|---|---|---|
| 4,521,831 | A * | 6/1985 | Thayer | 362/570 |
| 4,793,007 | A | 12/1988 | Barnett | |
| 4,958,264 | A * | 9/1990 | Evendon | 362/106 |
| 5,408,393 | A | 4/1995 | Becker | |
| 5,438,494 | A | 8/1995 | Harlan | |
| 5,664,868 | A | 9/1997 | Montalbano et al. | |
| 6,616,294 | B1 | 9/2003 | Henry | |
| 7,156,536 | B1 | 1/2007 | McCorkle | |
| 7,549,763 | B2 * | 6/2009 | Kim et al. | 362/106 |
| D612,524 | S | 3/2010 | Booher | |
| 8,292,450 | B2 | 10/2012 | Kim | |
| 2009/0283558 | A1 * | 11/2009 | Wanzer | 224/181 |
| 2010/0083413 | A1 * | 4/2010 | McGovern | 2/6.6 |

* cited by examiner

*Primary Examiner* — Alexander Garlen
(74) *Attorney, Agent, or Firm* — Wendy W. Koba

(57) ABSTRACT

An illumination system comprises a single mounting bracket that fits across the front of a safety helmet and terminates on each end in a holding fixture that secures a flashlight in a removable arrangement. The mounting bracket is configured such that the pair of flashlights will be positioned on either side of, and against, the sides of the helmet. The mounting bracket includes one or more centrally-located apertures that accommodate pre-existing fasteners used, for example, to attach a shield to the front of the helmet (the shield carrying insignia identifying the emergency organization).

9 Claims, 4 Drawing Sheets

ILLUMINATION SYSTEM FOR SAFETY HELMET

CROSS-REFERENCE TO RELATED APPLICATIONS

This application claims the benefit of U.S. Provisional Application No. 61/562,608, filed Nov. 22, 2011 and herein incorporated by reference.

TECHNICAL FIELD

The present invention relates to an illumination system for a safety helmet and, more particularly, to a portable light and bracket mounting system for attachment to a safety helmet, such as a firefighter's helmet.

BACKGROUND OF THE INVENTION

The prior art is replete with arrangements for incorporating a flashlight or other illumination source with a safety helmet (such as a firefighter's helmet). In some cases, a flashlight is held in place against the side of a helmet by a large-sized rubber strap that surrounds the helmet. While somewhat satisfactory, the rubber strap may break, or the light may become dislodged from the strap. Inasmuch as the helmet is generally being used in an emergency situation, these problems with a strap-secured light are of a concern.

Some configurations have been developed for attaching a mounting bracket to the side of a helmet, and then supporting a flashlight in this mounting bracket. See, for example, U.S. Pat. No. 5,664,868 issued to D. Montalbano et al. on Sep. 9, 1997 and entitled "Helmet Rigid Flashlight Bracket". In this arrangement, a rigid flashlight bracket is attached to the brim of a helmet by the user, where the user himself attaches the bracket at a location that is useful for that particular purpose. The bracket is formed to include a retainer that is shaped to hold a specific type of small, rectangular flashlight. The flashlight itself is merely seated in the bracket retainer and not otherwise fixedly attached to the bracket.

U.S. Pat. No. 5,438,494 issued to B. L. Harlan on Aug. 1, 1995 and entitled "Light Holder for Head Gear" describes an alternative type of structure which comprises a leaf-spring strap that is shaped to surround the circumference of a conventional penlight-sized flashlight and hold the flashlight securely in place. The opposing end of the leaf-spring strap comprises a bolted fastener that comes apart to be bolted onto an opening formed in the side of the safety helmet.

It has been found that side-mounted arrangements, such as those described above, are not preferable configurations for many situations. For example, the inclusion of a flashlight on only one side of a helmet results in an unbalanced fitting of the helmet, which may impact the effectiveness of the user or, at the very least, serve as a source of unwanted distraction. Additionally, the extension of the flashlight beyond the profile of the helmet (including those arrangements where a flashlight is attached under a brim of a helmet) results in the light sometimes coming loose or getting stuck in the surroundings. Moreover, the presence of the flashlight in that region may impact the user's field of view—a hazard in emergency situations.

Therefore, a need remains for an arrangement for illuminating the area in front of a safety helmet that does not have any of the drawbacks mentioned above.

SUMMARY OF THE INVENTION

The needs remaining in the prior art are addressed by the present invention, which relates to an illumination system for a safety helmet and, more particularly, to a portable light and bracket mounting system for attachment to a safety helmet, such as a firefighter's helmet.

In accordance with a preferred embodiment of the present invention, an illumination system comprises a single mounting bracket that fits across the front of a safety helmet and terminates on each end in a flashlight holder that is positioned on either side of, and against, the sides of the helmet. The mounting bracket includes one or more centrally-located apertures that accommodate pre-existing connections used, for example, to attach a shield to the front of the helmet (the shield carrying insignia identifying the emergency organization).

It is an advantage of the arrangement of the present invention that a front-mounted arrangement does not require any other mechanisms to be added to a safety helmet in order to attach the illumination system, since most safety helmets including an identifying shield on the front.

In a preferred embodiment of the present invention, the flashlight holder mechanisms formed at both ends of the mounting bracket are attached thereto by an adjustable ratchet mechanism so that the user may adjust the direction of the light beam (angling upward or downward, as necessary).

In one particular arrangement, the present invention comprises an illumination system for use with a safety helmet, including: (1) a mounting bracket including a pair of attachment apertures for mating with a front, center portion of the safety helmet and (2) a pair of holding fixtures disposed at either end of the mounting bracket, wherein the mounting bracket is sized such that the pair of holding fixtures are positioned on sides of the helmet, each holding fixture including a clamping arrangement for removably attaching a light source thereto.

In another embodiment, the present invention takes the form of a pair of side-mounted brackets, each including a ratchet assembly, to allow for the lights to be attached to either side of the helmet.

Other and further embodiments of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

The present invention addresses the concerns mentioned above and discloses an arrangement for adding an illumination source to a safety helmet that uses a mounting bracket for holding a pair of balanced light sources on either side of the helmet itself. The mechanisms for attaching the light sources to the mounting bracket may take the form of a ratchet in one embodiment, allowing for the user to adjust the beams of light into a preferred direction for a particular situation.

Figure 1:
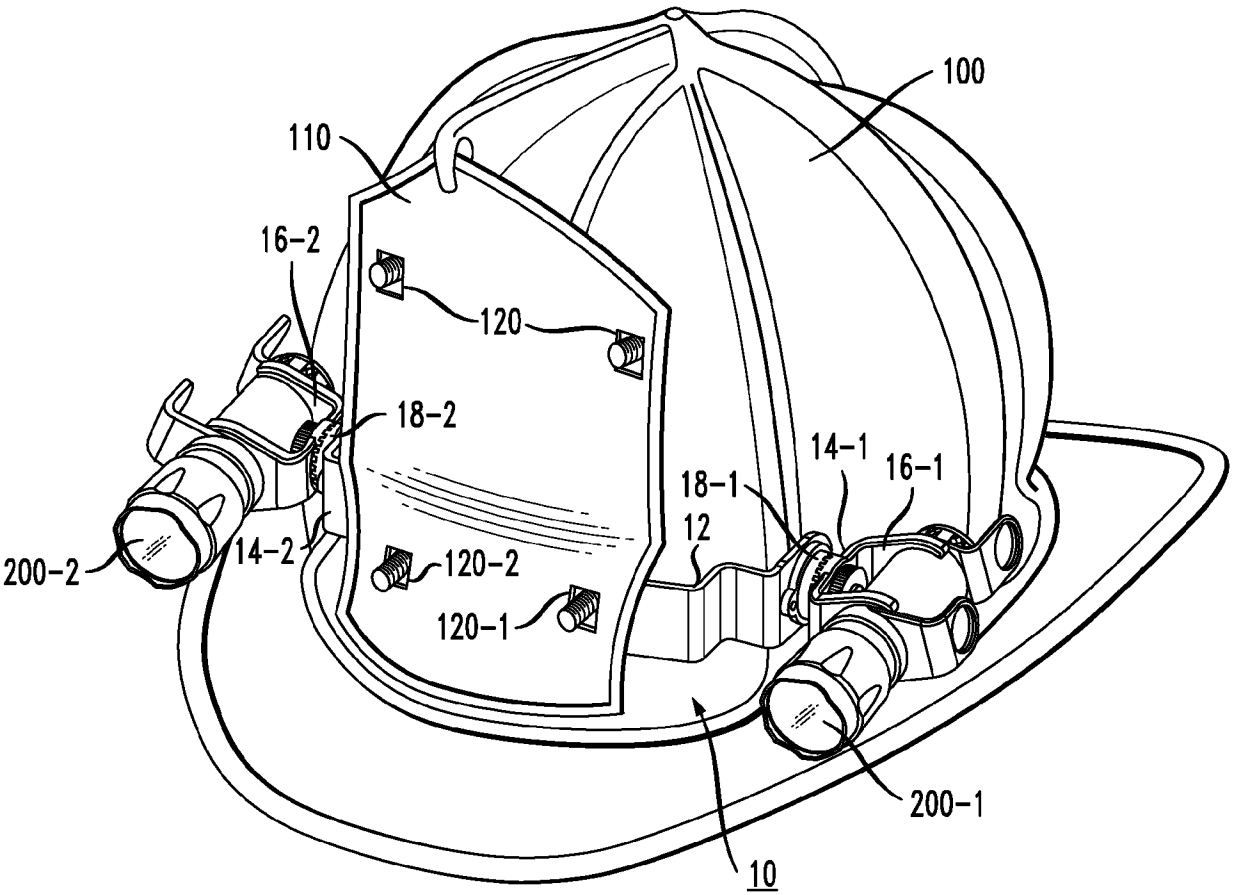
FIG. 1 is an exemplary embodiment of the illumination system of the present invention, in this case shown as attached to a typical safety helmet.

FIG. 1 illustrates an exemplary illumination system 10 formed in accordance with the present invention, as disposed in place on a conventional safety helmet 100. As shown, illumination system 10 includes a mounting bracket 12 that attaches behind an identifying shield 110 as found on most safety helmets. A set of fasteners 120 are used to attach shield 110 to helmet 100, where a pair of fasteners 120-1 and 120-2 from this set are used, as described below, to attach mounting bracket 12 to helmet 100, in accordance with the present invention.

A pair of light sources 200-1 and 200-2 are used with illumination system 10 of the present invention and are attached to mounting bracket 12 via a pair of holding fixtures 14. Referring to FIG. 1, a first light source 200-1 is shown as placed within a first holding fixture 14-1 formed at a first end termination of mounting bracket 12. A second light source 200-2 is placed within a second holding fixture 14-2 formed at a second, opposing end termination of mounting bracket 12 (this formation is better shown in later figures). As will be described in detail below, each holding fixture 14 includes a clamping arrangement 16 for holding light source 200 securely in place, while also allowing for light source 200 to be removed by the user, when desired. In one embodiment, clamping arrangement 16 comprises a pair of C-clamp members that exert a sufficient force on light source 200 to hold it securely, yet allow for an individual to pull the light source away, when necessary. As will also be described in more detail below, a preferred embodiment of the present invention utilizes an adjustable ratchet mechanism 18 in combination with clamping arrangement 16 to allow for the user to adjust the angle of the light beam with respect to the helmet.

The utilization of a pair of light sources 200-1, 200-2 with illumination system 10 results in forming a "balanced" configuration, as opposed to many prior art arrangements that use only a single light attached to one side of a helmet. The pair of sources mounted on a single bracket will naturally light up a broad, balanced field of view for the user, moving in the same direction as the user's head as the helmet moves. That is, the pair of sources will naturally "point" in the direction the user will be looking. The lights themselves are small enough to remain within the profile of the helmet.

Figure 2:
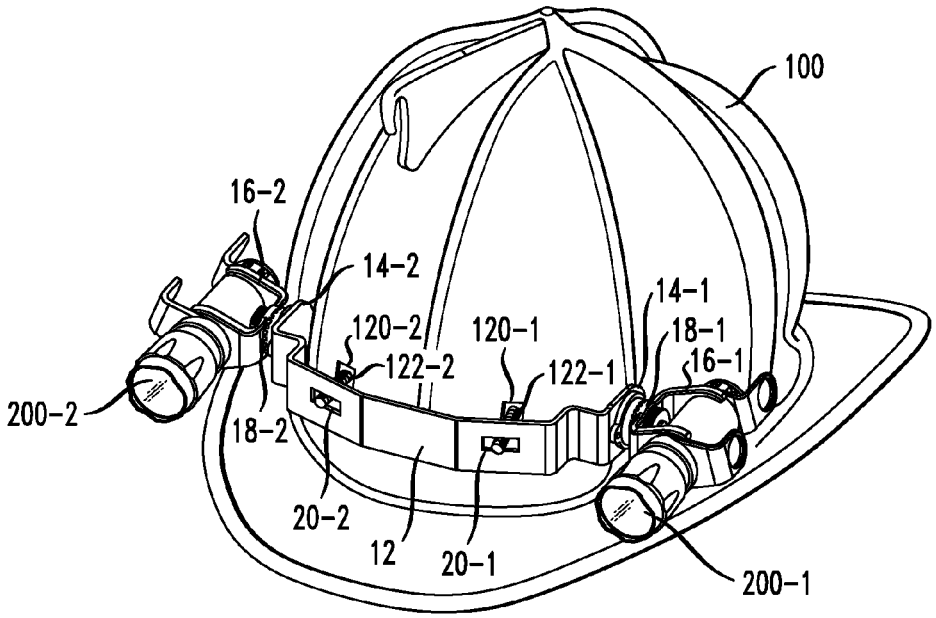
FIG. 2 is a view of the embodiment of FIG. 1, with the identifying shield removed to particularly show the placement of the attachment apertures of the mounting bracket and its attachment using the same fasteners as used for the shield itself.

FIG. 2 illustrates illumination system 10 as placed on helmet 100 before an identifying shield is returned in place. In a preferred embodiment of the present invention, mounting bracket 12 includes a pair of slots 20-1 and 20-2 that mate with shield fasteners 120-1 and 120-2, respectively. For example, a pair of threaded bolts 122-1, 122-2 may be permanently attached to the underside of helmet 100 (not shown), with slots 20-1 and 20-2 positioned over threaded bolts 122-1 and 122-2, respectively. By using slots 20, mounting bracket 12 may easily fit on helmets that use a variety of spacings between the shield fasteners. In any event, once bracket 12 is placed on threaded blots 122-1 and 122-2, the identifying shield may be re-positioned in place and attached to helmet 100, using, for example, a locking washer and nut combination.

Figure 6:
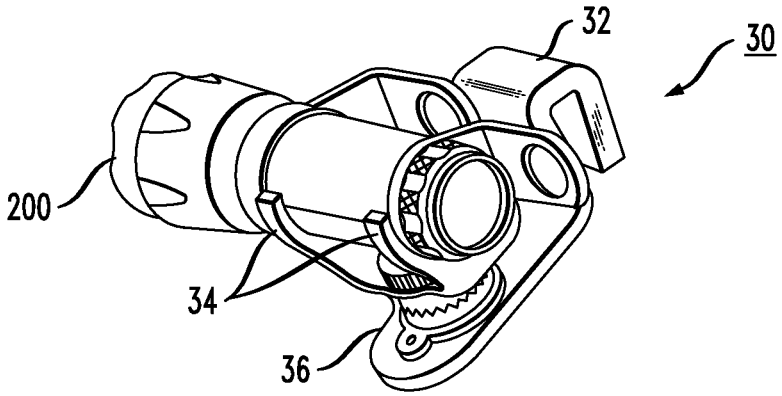
FIG. 6 is an isometric view of an alternative embodiment of the present invention, in the form of a side-mounted configuration.
Figure 7:
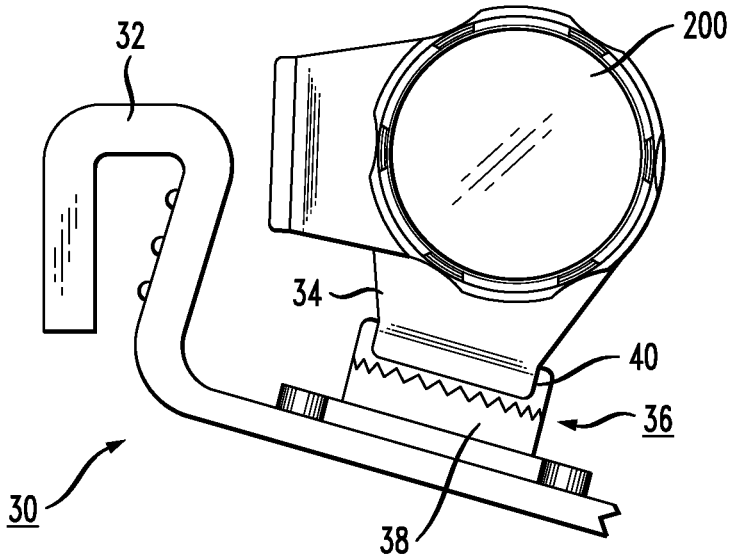
FIG. 7 is an end view of the embodiment of FIG. 6.

It is to be understood that the specific arrangement for attaching an identifying shield to a safety helmet is not germane to the subject matter of the present invention, which is particularly directed in one embodiment to providing an illumination system 10 in the form of a mounting bracket 12 and a pair of holding fixtures 14 for supporting light sources in place on either side of a safety helmet. Further, if illumination system 10 is to be used with a helmet that does not include a front-mounted shield, a conventional, suitable fastening arrangement may be used to directly attach mounting bracket 12 to a front portion of the safety helmet. Alternatively, the configuration as shown in FIGS. 6 and 7, and described below, may be utilized in this case.

Figure 3:
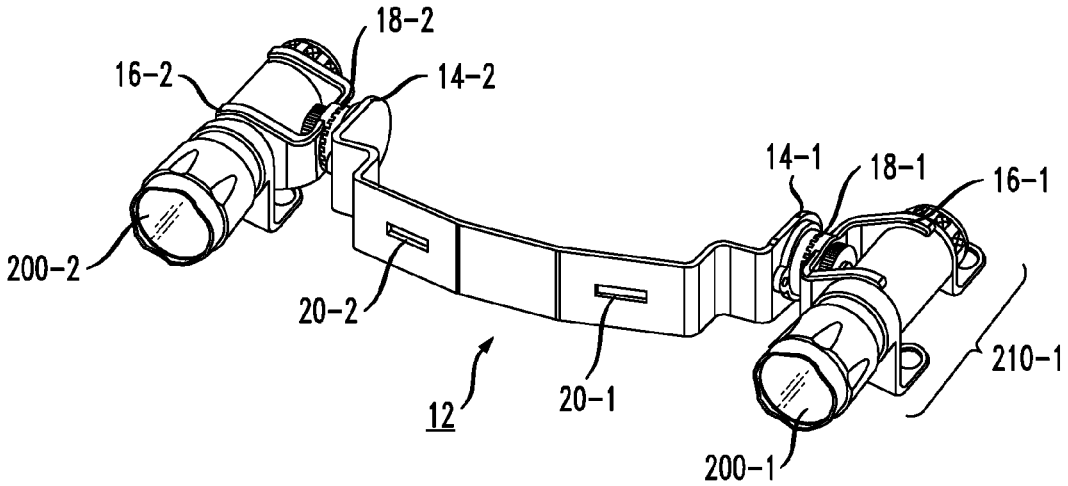
FIG. 3 is an isometric view of the illumination system of the present invention.

FIG. 3 is an isometric view of illumination system 10 of the present invention. As shown, mounting bracket 12 is formed to include a pair of slots 20 that will accommodate attachment arrangements used in most conventional safety helmets to attach an identifying shield to the front of the helmet. Mounting bracket 12 is shown as terminating in holding fixtures 14 formed at either end of mounting bracket 14. Each holding fixture 14 includes a clamping arrangement 16 for removably attaching a light source 200 to the holding fixture 14. In the particular view as shown in FIG. 3, clamping arrangement 16 comprises a pair of C-clamps that will hold light source 200 securely in place, while also allowing the user to remove the light source when necessary.

In this particular embodiment, each light source 200 is configured to include a carabiner mount 210 (carabiner mount 210-1 with light source 200-1 and carabiner mount 210-2 with light source 200-2). In a preferred embodiment of the present invention as mentioned above, light sources 200 are removably attached to mounting bracket 12 via a clamping arrangement 16, allowing the user to remove a light, as necessary, in some situations. The inclusion of carabiner mounts 210 allows for the user to then attach the light source to a carabiner on a separate tool, rope or other instrument, such as may be necessary in a rescue operation.

Figure 4:
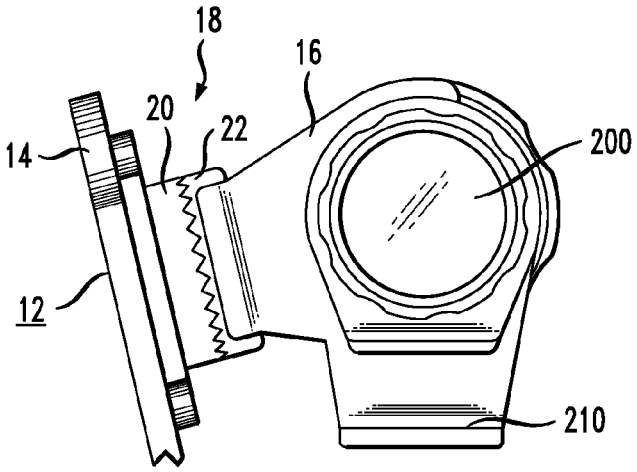
FIG. 4 is an enlarged view of an adjustable ratchet mechanism as shown in the arrangement of FIG. 3.

Also particularly illustrated in the view of FIG. 3 is adjustable ratchet mechanism 18 that is used in a preferred embodiment of the present invention to provide adjustment of the angle of light sources 200 with respect to mounting bracket 12. FIG. 4 is a close-up view of a portion of the arrangement of FIG. 3, clearly showing adjustable ratchet mechanism 18. In the specific embodiment illustrated in FIGS. 3 and 4, adjustable ratchet mechanism 18 is shown as comprising a pair of interlocking rotary members 20 and 22, where member 20 is held in a fixed position on mounting bracket 12, and member 22 may be adjusted by the user to modify the angle of the light beam with respect to mounting bracket 12. The interlocking gear teeth formed on each member can be seen in both FIGS. 3 and 4. When the user desires to adjust the position of the light beam, he pulls out member 22 to disengage its gear teeth from the current position, rotates light source 200 to a desired angle, and then re-engages member 22 with member 20 in a new, adjusted position.

Figure 5:
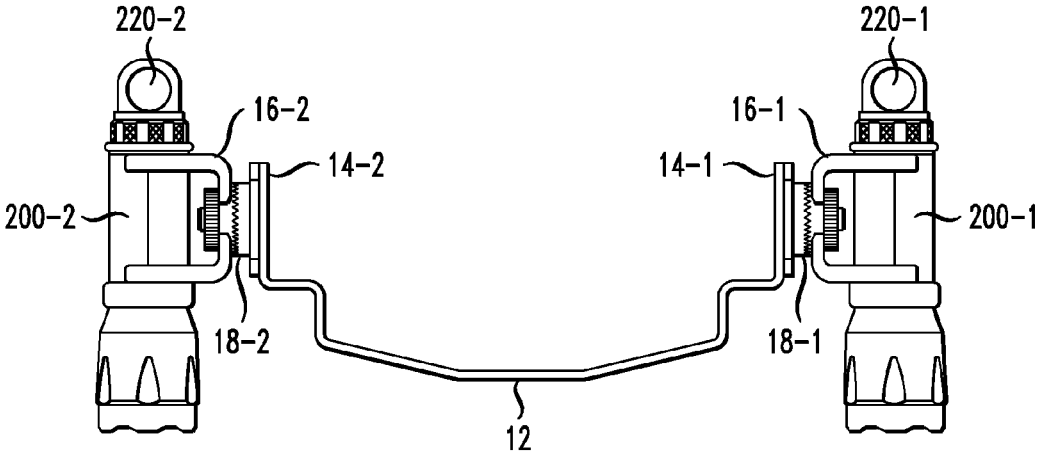
FIG. 5 is a top view of a particular embodiment of the illumination system of the present invention.

FIG. 5 is a top view of this embodiment of the present invention. Clamping arrangement 16 of holding fixture 14 is clearly shown in this view, as well as adjustable ratchet mechanism 18.

As mentioned above, there are times when it is not possible to attach a mounting bracket to a front portion of a helmet. In this case, a pair of small mounting brackets can be used, one each attached to a side of a helmet. FIG. 6 is an isometric view of an exemplary side illumination system 30 formed in accordance with the present invention. In this case, side illumination system 30 includes a mounting bracket 32 for attaching illumination system 30 to a side of a helmet. Similar to the embodiment described above, illumination system 30 includes a pair of holding fixtures 34 (such as C-clamps) for removably holding a light source 200 in place.

Preferably, side illumination system 30 utilizes an adjustable ratchet mechanism 36 to allow for the angle of the attached light source 200 to be adjusted with respect to mounting bracket 32. FIG. 7 is an end view of illumination system 30, which clearly illustrates adjustable ratchet mechanism 36, including a first rotary member 38 attached to mounting bracket 32 and a second rotary member 40 attached to holding fixture 34. As discussed above, each rotary member includes interlocking gear teeth that allows for a user to move second rotary member 40 to be adjusted with respect to first rotary member 38 and thus adjust the positioning of the light source 200.

It is to be understood that the inclusion of a ratchet mechanism for adjusting the beam direction of the light sources is exemplary only, but is considered to be a preferred embodiment of the present invention. Indeed, various and other modifications may be made to the apparatus as shown in these figures and all such modifications are considered to fall within the scope of the present invention as defined by the claims appended hereto.

Moreover, while initially contemplated for use with firefighting helmets, it is to be understood that in its broadest terms the illumination system of the present invention may be used with a variety of helmet designs (including sports helmets, motorcycles, etc.) and may also find use as an independent element separate from the helmet itself (i.e., on a belt, backpack, stroller, etc.).

What is claimed is:

1. An illumination system for use with a safety helmet, the illumination system comprising:

a mounting bracket formed to comprise opposing end terminations, the mounting bracket including a pair of attachment apertures mating with a front, center portion of the safety helmet; and a pair of like holding fixtures disposed at either end termination of the mounting bracket, wherein the mounting bracket is sized such that the pair of like holding fixtures are positioned on sides of the helmet, each holding fixture including a clamping arrangement removably attaching a light source thereto.

2. The illumination system as defined in claim 1 wherein the pair of attachment apertures comprise a pair of longitudinal slots, the longitudinal slots for accommodating different positioning of fastening arrangements associated with different safety helmets.

3. The illumination system as defined in claim 1 wherein each holding fixture is adjustable to permit adjustment of the angle of a created light beam with respect to the mounting bracket.

4. The illuminating system as defined in claim 3 wherein an adjustable ratchet mechanism is used to provide for adjustment of a light beam.

5. The illuminating system as defined in claim 4 wherein the adjustable ratchet mechanism includes a first member fixedly attached to the mounting bracket and a second member fixedly attached to the clamping arrangement, the second member capable of rotating with respect to the first member and each of the first and second members including interlocking gear teeth to hold a predetermined, adjustable position upon proper orientation of the second member with respect to the first member.

6. An illumination system for use with a safety helmet, the illumination system comprising:

a mounting bracket formed to comprise opposing end terminations, the mounting bracket including a pair of attachment apertures mating with a front, center portion of the safety helmet; and a pair of like holding fixtures disposed at either end termination of the mounting bracket, wherein the mounting bracket is sized such that the pair of like holding fixtures are positioned on sides of the helmet, each holding fixture including a clamping arrangement removably attaching a light source thereto; and a light source attached to each clamping arrangement.

7. The illumination system as defined in claim 6 wherein the pair of attachment apertures comprise a pair of longitudinal slots, the longitudinal slots for accommodating different positioning of fastening arrangements associated with different safety helmets.

8. The illumination system as defined in claim 6 wherein each holding fixture is adjustable to permit adjustment of the angle of a light source with respect to the mounting bracket.

9. The illumination system as defined in claim 8 wherein each light source further comprises a carabiner mount.

* * * * *